US006499244B1

(12) United States Patent
Smith et al.

(10) Patent No.: US 6,499,244 B1
(45) Date of Patent: Dec. 31, 2002

(54) FIREARM SAFETY LOCK

(76) Inventors: Gerald C. Smith, One Tyler Ct., Medford, NJ (US) 08055; Matthew T. Colegrove, 15525 Marvin Dr., Reynoldsburg, OH (US) 43068

( * ) Notice: Subject to any disclaimer, the term of this patent is extended or adjusted under 35 U.S.C. 154(b) by 0 days.

(21) Appl. No.: 09/838,935

(22) Filed: Apr. 20, 2001

(51) Int. Cl.[7] ..... F41A 17/02
(52) U.S. Cl. ..... 42/70.11
(58) Field of Search ..... 42/70.11, 96

(56) References Cited

U.S. PATENT DOCUMENTS

| | | | | | |
|---|---|---|---|---|---|
| 633,939 | A | | 9/1899 | Acerman | |
| 2,479,107 | A | | 8/1949 | Garretson | |
| 3,089,272 | A | * | 5/1963 | McKinlay | 42/70.11 |
| 3,193,959 | A | * | 7/1965 | Jaycox | 42/70.11 |
| 3,378,943 | A | * | 4/1968 | Valburg | 42/70.11 |
| 3,553,877 | A | | 1/1971 | Welch et al. | |
| 3,605,311 | A | | 9/1971 | Hermann | |
| 3,708,901 | A | | 1/1973 | Wolter | |
| 3,765,115 | A | | 10/1973 | Johansson et al. | |
| 3,882,622 | A | | 5/1975 | Perlotto | |
| 4,136,475 | A | | 1/1979 | Centille | |
| 4,266,356 | A | * | 5/1981 | Jarvinen | 42/70.11 |
| 4,654,992 | A | | 4/1987 | Lavergne | |
| 4,835,894 | A | * | 6/1989 | Libassi | 42/70.11 |
| 5,048,211 | A | | 9/1991 | Hepp | |
| 5,231,236 | A | * | 7/1993 | Del Real et al. | 42/70.11 |
| 5,233,777 | A | | 8/1993 | Waterman, Jr. et al. | |
| 5,331,759 | A | * | 7/1994 | Marceau et al. | 42/70.11 |
| 5,398,438 | A | | 3/1995 | Williams | |
| 5,491,918 | A | | 2/1996 | Elmstedt | |
| 5,669,252 | A | * | 9/1997 | Bentley | 42/70.04 |
| 5,680,724 | A | * | 10/1997 | Peterken | 42/70.11 |
| 5,737,864 | A | | 4/1998 | Otto | |
| 6,226,914 | B1 | * | 5/2001 | Reed | 42/70.08 |

FOREIGN PATENT DOCUMENTS

| | | | |
|---|---|---|---|
| DE | 2920679 | A1 | 9/2000 |
| WO | WO 96/29560 | A2 * | 9/1996 |

* cited by examiner

*Primary Examiner*—Charles T. Jordan
*Assistant Examiner*—John W. Zerr

(57) ABSTRACT

A firearm safety lock for positioning in the chamber of a firearm and preventing the firing of the firearm until the device is removed from the chamber. The firearm safety lock includes an elongate housing for positioning in a chamber of a firearm, and having a longitudinal axis extending between the opposite first and second ends. The housing has an interior and the second end thereof has an opening. A first end member is mounted on and protrudes from the first end of the housing. A lock channel extends from the housing. A second end member is mounted on the second end of the housing. The second end member is slidably mounted in the interior of the housing. The second end member has a retracted position wherein the second end member is generally retracted into the interior of the housing and an extended position wherein the second locating member is generally extended from the second end of the housing for engaging a second end of the chamber of the firearm to lodge the housing in the chamber and preclude removal of the housing from the chamber. A locking mechanism is provided for moving the second end member between the retracted and extended positions. The first end member has a substantially frusta-conical portion for centering the first end member in a first end of the chamber of the firearm and wherein the second end member has a substantially frusta-conical portion formed on the second end of the body member for centering the second end member in the second end of the chamber of the firearm.

18 Claims, 3 Drawing Sheets

FIREARM SAFETY LOCK

BACKGROUND OF THE INVENTION

1. Field of the Invention

The present invention relates to firearm firing prevention devices and more particularly pertains to a new firearm safety lock for positioning in the chamber of a firearm and preventing the firing of the firearm until the device is removed from the chamber.

2. Description of the Prior Art

The use of firearm firing prevention devices is known in the prior art. More specifically, firearm firing prevention devices heretofore devised and utilized are known to consist basically of familiar, expected and obvious structural configurations, notwithstanding the myriad of designs encompassed by the crowded prior art which have been developed for the fulfillment of countless objectives and requirements.

The firearm safety lock according to the present invention substantially departs from the conventional concepts and designs of the prior art, and in so doing provides an apparatus primarily developed for the purpose of positioning in the chamber of a firearm and preventing the firing of the firearm until the device is removed from the chamber.

SUMMARY OF THE INVENTION

In view of the foregoing disadvantages inherent in the known types of firearm firing prevention devices now present in the prior art, the present invention provides a new firearm safety lock construction wherein the same can be utilized for positioning in the chamber of a firearm and preventing the firing of the firearm until the device is removed from the chamber.

The present invention generally comprises an elongate housing for positioning in a chamber of a firearm, and having a longitudinal axis extending between the opposite first and second ends. The housing has an interior and the second end thereof has an opening. A first end member is mounted on and protrudes from the first end of the housing. A lock channel extends from the housing. A second end member is mounted on the second end of the housing. The second end member is slidably mounted in the interior of the housing. The second end member has a retracted position wherein the second end member is generally retracted into the interior of the housing and an extended position wherein the second locating member is generally extended from the second end of the housing for engaging a second end of the chamber of the firearm to lodge the housing in the chamber and preclude removal of the housing from the chamber. A locking mechanism is provided for moving the second end member between the retracted and extended positions. The first end member has a substantially frusta-conical portion for centering the first end member in a first end of the chamber of the firearm and wherein the second end member has a substantially frusta-conical portion formed on the second end of the body member for centering the second end member in the second end of the chamber of the firearm.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new firearm safety lock apparatus and method which has many of the advantages of the firearm firing prevention devices mentioned heretofore and many novel features that result in a new firearm safety lock which is not anticipated, rendered obvious, suggested, or even implied by any of the prior art firearm firing prevention devices, either alone or in any combination thereof.

It is another object of the present invention to provide a new firearm safety lock that may be easily and efficiently manufactured and marketed.

It is a further object of the present invention to provide a new firearm safety lock that is of a durable and reliable construction.

An even further object of the present invention is to provide a new firearm safety lock which is susceptible of a low cost of manufacture with regard to both materials and labor, and which accordingly is then susceptible of low prices of sale to the consuming public, thereby making such firearm safety lock economically available to the buying public.

Still yet another object of the present invention is to provide a new firearm safety lock which provides in the apparatuses and methods of the prior art some of the advantages thereof, while simultaneously overcoming some of the disadvantages normally associated therewith.

Still another object of the present invention is to provide a new firearm safety lock for positioning in the chamber of a firearm and preventing the firing of the firearm until the device is removed from the chamber.

Yet another object of the present invention is to provide a new firearm safety lock which includes an elongate housing for positioning in a chamber of a firearm, and having a longitudinal axis extending between the opposite first and second ends. The housing has an interior and the second end thereof has an opening. A first end member is mounted on and protrudes from the first end of the housing. A lock channel extends from the housing. A second end member is mounted on the second end of the housing. The second end member is slidably mounted in the interior of the housing. The second end member has a retracted position wherein the second end member is generally retracted into the interior of the housing and an extended position wherein the second locating member is generally extended from the second end of the housing for engaging a second end of the chamber of the firearm to lodge the housing in the chamber and preclude removal of the housing from the chamber. A locking mechanism is provided for moving the second end member between the retracted and extended positions. The first end member has a substantially frusta-conical portion for centering the first end member in a first end of the chamber of the firearm and wherein the second end member has a substantially frusta-conical portion formed on the second end of the body member for centering the second end member in the second end of the chamber of the firearm.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
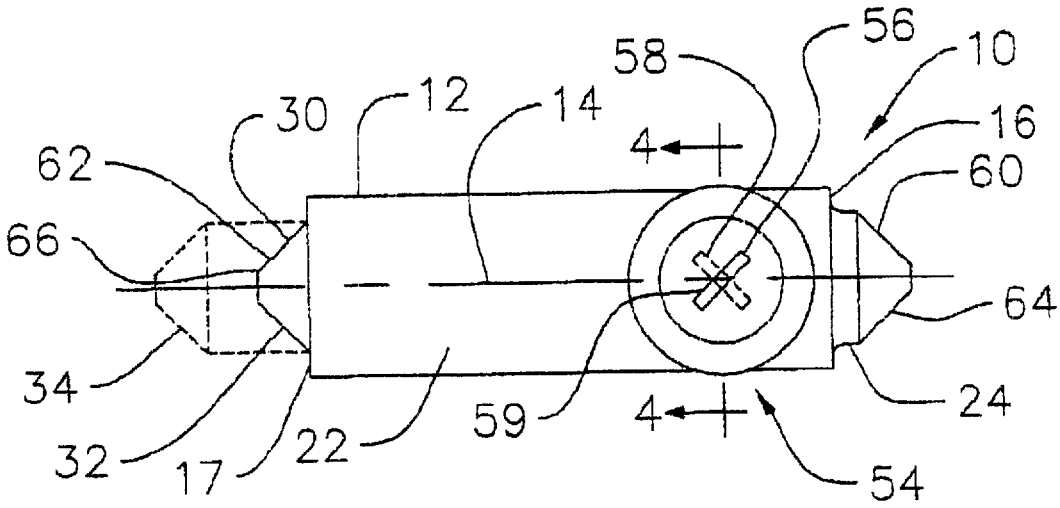
FIG. 1 is a schematic front view of a new firearm safety lock according to the present invention.
Figure 2:
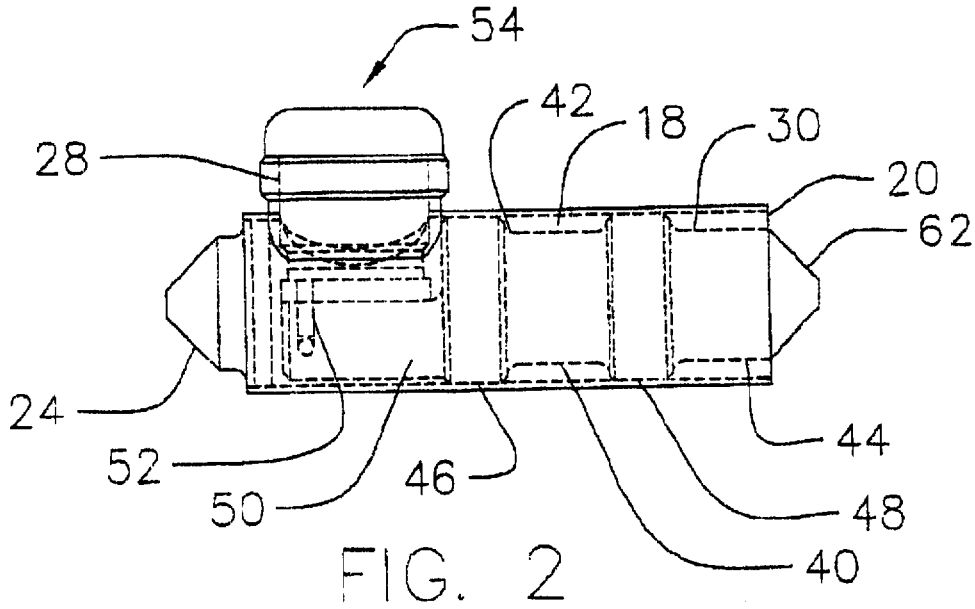
FIG. 2 is a schematic top view of the present invention.
Figure 3:
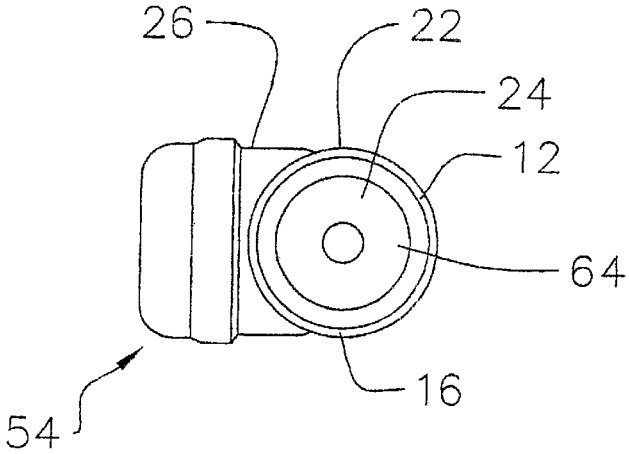
FIG. 3 is a schematic end view of the present invention.
Figure 4:
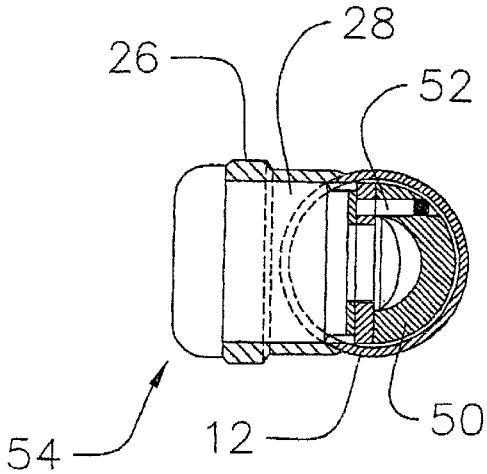
FIG. 4 is a schematic sectional view of the present invention taken along line 4—4 of FIG. 1.
Figure 5:
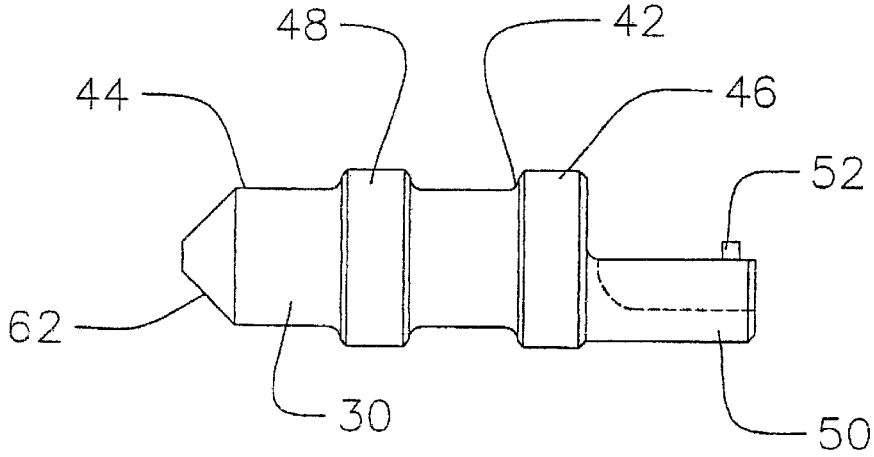
FIG. 5 is a schematic side view of the second end member of the present invention.
Figure 6:
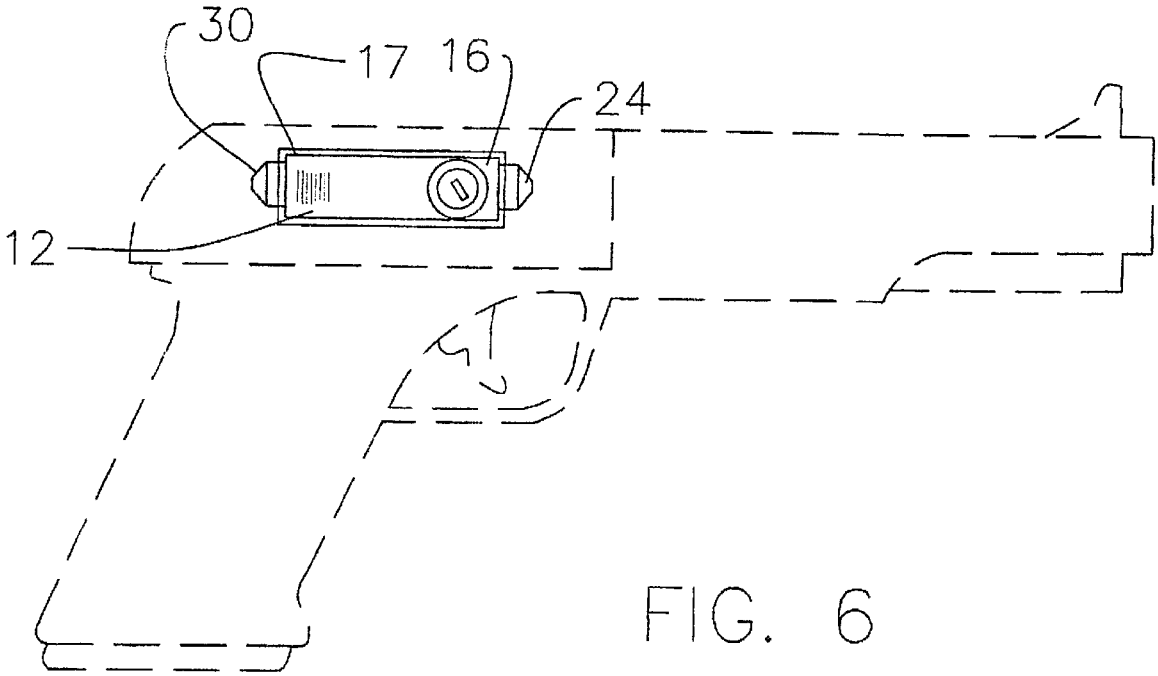
FIG. 6 is a schematic side view of the firearm safety lock of the present invention shown inserted into the chamber of a firearm.

With reference now to the drawings, and in particular to FIGS. 1 through 6 thereof, a new firearm safety lock embodying the principles and concepts of the present invention and generally designated by the reference numeral 10 will be described.

The firearm locking device 10 of the invention is adapted for removably positioning in the chamber of a firearm so that the firearm cannot be loaded with ammunition and fired.

The firearm locking device 10 includes a housing adapted for positioning in a chamber of a firearm. The housing 12 is preferably elongate with a longitudinal axis 14 that extends between the opposite first 16 and second 17 ends. The housing 12 has an interior 18, and the interior may be generally hollow. The second end 17 of the housing has an opening 20. The housing 12 has an outer surface 22, and the outer surface may be substantially cylindrical to facilitate the insertion of the housing into the chamber of a firearm.

A first end member 24 is mounted on the first end 16 of the housing and protrudes from the first end. The first end member 24 is most preferably mounted on the housing in a manner that prevents movement of the first end member with respect to the housing. Illustratively, the first end member may be press fit in an opening in the first end of the housing.

A lock channel 26 may extend from the housing 12. The lock channel 26 may extend in a substantially perpendicular orientation to the longitudinal axis 14 of the housing. The lock channel 26 may be positioned adjacent to the first end 16 of the housing. The lock channel 26 has a channel interior 28 in communication with the interior 18 of the housing.

A second end member 30 is mounted on the second end 17 of the housing. The second end member 30 is slidably mounted in the interior 18 of the housing. The second end member 30 has a retracted position 32 wherein the second end member is generally retracted into the interior 18 of the housing 12 and an extended position 34 wherein the second locating member is generally extended from the second end 17 of the housing for engaging a second end of the chamber of the firearm to lodge the housing in the chamber and preclude removal of the housing from the chamber.

The second end member 30 may include a body portion 40 positioned in the interior 18 of the housing. The body portion 40 has a first end 42 and a second end 44 with a longitudinal axis extending between the first and second ends. A first annular positioning flange 46 may extend about the body portion 40 for centering the body member in the interior 18 of the housing. The first annular positioning flange 46 may be positioned toward the first end 42 of the body portion. A second annular positioning flange 48 may extend about the body portion 40 for centering the body member in the interior 18 of the housing. The second annular positioning flange 48 may be positioned toward the second end 44 of the body portion. The first 46 and second 48 annular positioning flange are preferably spaced from each other for keeping the body portion 40 in a proper orientation in the interior of the housing without binding. Significantly, the annular positioning flanges 46, 48 permit the body portion 40 to have a reduced thickness or diameter, thus reducing the weight of the second end member 30 and the overall weight of the lock 10.

An actuating member 50 may extend from the first end 42 of the body portion 40. The actuating member 50 may be located on one side of a plane extending through a central longitudinal axis of the body member 40. The actuating member 50 may have a generally semi-cylindrical shape. The actuating member 50 may have an actuating pin 52 extending from the actuating member.

A locking mechanism 54 is provided for moving the second end member 30 between the retracted and extended positions. The locking mechanism 54 is located in the lock channel 26. The locking mechanism 54 extends into the interior 18 of the housing and acting on the actuating pin 52 on the actuating member 50 of the second end member 30. The locking mechanism 54 has a key slot 56 for receiving a key to actuate the locking mechanism. The key slot has a lock position 58 corresponding to the extended position 34 of the second end member 30 and an unlock position 59 corresponding to the retracted position 32 of the second end member. The key slot 56 may rotate through approximately 90 degrees between the lock 58 and unlock 59 positions.

Significantly, the first end member 24 has a substantially frusta-conical portion 60 for centering the first end member 24 in a first end 16 of the chamber of the firearm. The second end member 30 has a substantially frusta-conical portion 62 formed on the second end 44 of the body member 40 for centering the second end member in the second end of the chamber of the firearm. A perimeter surface 64, 66 of each of the frusta-conical portions 60, 62 of the first and second end members is characterized by diametrically opposite sides of the perimeter surface being oriented at approximately 90 degrees with respect to each other. The tapering shape of the end members not only helps to center the lock in the chamber of the firearm as the second end member is extended from the housing, but also facilitates insertion and removal of the lock into and out of the chamber when the second end member is in the retracted position. The tapering end portions of the lock also facilitate the fitting of the lock in chambers of firearms of various calibers and chamber dimensions.

In use, the lock 10 is positioned in the chamber of a firearm, and a key inserted in the key slot 56 is rotated from an unlock position to a lock position, moving the second end member from a retracted position to an extended position. The frusta-conical portions of the first and second end members tend to center the lock 10 in the chamber.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A firearm locking device for removably positioning in the chamber of a firearm, the device comprising:

a housing adapted for positioning in a chamber of a firearm, the housing being elongate with a longitudinal axis extending between opposite first and second ends, the housing having an interior, the second end of the housing having an opening;

a first end member mounted on the first end of the housing and protruding from the first end;

a lock channel extending from the housing;

a second end member mounted on the second end of the housing, the second end member being slidably mounted in the interior of the housing, the second end member having a retracted position wherein the second end member is generally retracted into the interior of the housing and an extended position wherein the second end member is generally extended from the second end of the housing for engaging a second end of the chamber of the firearm to lodge the housing in the chamber and preclude removal of the housing from the chamber; and a locking means for moving the second end member between the retracted and extended positions;

wherein the first end member has a substantially frusta-conical portion for centering the first end member in a first end of the chamber of the firearm and wherein the second end member has a substantially frusta-conical portion formed on a second end of the second end member for centering the second end member in the second end of the chamber of the firearm;

wherein the second end member includes a body portion positioned in the interior of the housing, the body portion having a first end and a second end with a longitudinal axis extending between the first and second ends; and a first annular positioning flange extending about the body portion for centering the body portion in the interior of the housing, the first annular positioning flange being positioned toward the first end of the body portion.

2. The firearm locking device of claim 1 wherein the housing has an outer surface, the outer surface of the housing being substantially cylindrical.

3. The firearm locking device of claim 1 wherein the first end member is mounted on the housing in a manner preventing movement of the first end member with respect to the housing.

4. The firearm locking device of claim 1 wherein the lock channel extends substantially perpendicular to the longitudinal axis of the housing, the lock channel being positioned adjacent to the first end of the housing, the lock channel having a channel interior in communication with the interior of the housing.

5. The firearm locking device of claim 1 additionally comprising a second annular positioning flange extending about the body portion for centering the body portion in the interior of the housing, the second annular positioning flange being positioned toward the second end of the body portion.

6. The firearm locking device of claim 1 additionally comprising an actuating member extending from the first end of the body portion, the actuating member being located on one side of a plane extending through a central longitudinal axis of the body portion, the actuating member having a generally semi-cylindrical shape, the actuating member having an actuating pin extending therefrom.

7. The firearm locking device of claim 4 wherein the locking means is located in the lock channel, the locking means extending into the interior of the housing.

8. The firearm locking device of claim 6 wherein the locking means actuates the actuating pin of the second end member, the locking means having a key slot for receiving a key to actuate the locking means, the key slot having a lock position corresponding to the extended position of the second end member and an unlock position corresponding to the retracted position of the second end member, the key slot rotating through approximately 90 degrees between the lock and unlock positions.

9. The firearm locking device of claim 1 wherein a perimeter surface of each of the frusta-conical portions of the first and second end members is characterized by diametrically opposite sides of the perimeter surface being oriented at approximately 90 degrees with respect to each other.

10. A firearm locking device for removably positioning in the chamber of a firearm, the device comprising:

a housing adapted for positioning in a chamber of a firearm, the housing being elongate with a longitudinal axis extending between opposite first and second ends, the housing having an interior, the interior of the housing being generally hollow, the second end of the housing having an opening, the housing having an outer surface, the outer surface of the housing being substantially cylindrical;

a first end member mounted on the first end of the housing and protruding from the first end, the first end member being mounted in a manner preventing movement of the first end member with respect to the housing;

a lock channel extending from the housing, the lock channel extending substantially perpendicular to the longitudinal axis of the housing, the lock channel being positioned adjacent to the first end of the housing, the lock channel having a channel interior in communication with the interior of the housing;

a second end member mounted on the second end of the housing, the second end member being slidably mounted in the interior of the housing, the second end member having a retracted position wherein the second end member is generally retracted into the interior of the housing and an extended position wherein the second end member is generally extended from the second end of the housing for engaging a second end of the chamber of the firearm to lodge the housing in the chamber and preclude removal of the housing from the chamber, the second end member comprising:

a body portion positioned in the interior of the housing, the body portion having a first end and a second end with a longitudinal axis extending between the first and second ends;

a first annular positioning flange extending about the body portion for centering the body portion in the interior of the housing, the first annular flange being positioned toward the first end of the body portion;

a second annular positioning flange extending about the body portion for centering the body portion in the interior of the housing, the second annular flange being positioned toward the second end of the body portion;

an actuating member extending from the first end of the body portion, the actuating member being located on one side of a plane extending through a central longitudinal axis of the body portion, the actuating member having a generally semi-cylindrical shape, the actuating member having an actuating pin extending therefrom;

a locking means for moving the second end member between the retracted and extended positions, the locking means being located in the lock channel, the locking means extending into the interior of the housing and acting on the actuating pin on the actuating member of the second end member, the locking means having a key slot for receiving a key to actuate the locking means, the key slot having a lock position corresponding to the extended position of the second end member and an unlock position corresponding to the retracted position of the second end member, the key slot rotating through approximately 90 degrees between the lock and unlock positions; and wherein the first end member has a substantially frusta-conical portion for centering the first end member in a first end of the chamber of the firearm and wherein the second end member has a substantially frusta-conical portion formed on the second end of the body portion for centering the second end member in the second end of the chamber of the firearm;

wherein a perimeter surface of each of the frusta-conical portions of the first and second end members is characterized by diametrically opposite sides of the perimeter surface being oriented at approximately 90 degrees with respect to each other.

11. A firearm locking device for removably positioning in the chamber of a firearm, the device comprising:

a housing adapted for positioning in a chamber of a firearm, the housing being elongate with a longitudinal axis extending between opposite first and second ends, the housing having an interior, the second end of the housing having an opening;

a first end member mounted on the first end of the housing and protruding from the first end;

a lock channel extending from the housing;

a second end member mounted on the second end of the housing, the second end member being slidably mounted in the interior of the housing, the second end member having a retracted position wherein the second end member is generally retracted into the interior of the housing and an extended position wherein the second end member is generally extended from the second end of the housing for engaging a second end of the chamber of the firearm to lodge the housing in the chamber and preclude removal of the housing from the chamber; and a locking means for moving the second end member between the retracted and extended positions;

wherein the first end member has a substantially frusta-conical portion for centering the first end member in a first end of the chamber of the firearm and wherein the second end member has a substantially frusta-conical portion formed on a second end of the second end member for centering the second end member in the second end of the chamber of the firearm;

wherein the second end member includes a body portion positioned in the interior of the housing, the body portion having a first end and a second end with a longitudinal axis extending between the first and second ends; and an actuating member extending from the first end of the body portion, the actuating member being located on one side of a plane extending through a central longitudinal axis of the body portion, wherein the actuating member has an actuating pin extending therefrom.

12. The firearm locking device of claim 11 wherein the actuating member has a generally semi-cylindrical shape.

13. The firearm locking device of claim 11 wherein the locking means actuates the actuating pin of the second end member, the locking means having a key slot for receiving a key to actuate the locking means, the key slot having a lock position corresponding to the extended position of the second end member and an unlock position corresponding to the retracted position of the second end member, the key slot rotating through approximately 90 degrees between the lock and unlock positions.

14. The firearm locking device of claim 11 wherein the housing has an outer surface, the outer surface of the housing being substantially cylindrical.

15. The firearm locking device of claim 11 wherein the first end member is mounted on the housing in a manner preventing movement of the first end member with respect to the housing.

16. The firearm locking device of claim 11 wherein the lock channel extends substantially perpendicular to the longitudinal axis of the housing, the lock channel being positioned adjacent to the first end of the housing, the lock channel having a channel interior in communication with the interior of the housing.

17. The firearm locking device of claim 16 wherein the locking means is located in the lock channel, the locking means extending into the interior of the housing.

18. The firearm locking device of claim 11 wherein a perimeter surface of each of the frusta-conical portions of the first and second end members is characterized by diametrically opposite sides of the perimeter surface being oriented at approximately 90 degrees with respect to each other.

* * * * *